US008082677B2

(12) United States Patent
Noviello

(10) Patent No.: US 8,082,677 B2
(45) Date of Patent: Dec. 27, 2011

(54) HOME LAUNDRY DRIER

(75) Inventor: Flavio Noviello, Aviano (IT)

(73) Assignee: Electrolux Home Products Corporation, N.V., Brussels (BE)

( * ) Notice: Subject to any disclaimer, the term of this patent is extended or adjusted under 35 U.S.C. 154(b) by 305 days.

(21) Appl. No.: 12/524,125

(22) PCT Filed: Feb. 13, 2008

(86) PCT No.: PCT/EP2008/001094

§ 371 (c)(1),
(2), (4) Date: Aug. 24, 2009

(87) PCT Pub. No.: WO2008/101623

PCT Pub. Date: Aug. 28, 2008

(65) Prior Publication Data

US 2010/0043245 A1 Feb. 25, 2010

(30) Foreign Application Priority Data

Feb. 23, 2007 (EP) ..... 07103016

(51) Int. Cl.
*F26B 19/00* (2006.01)

(52) U.S. Cl. ..... 34/60; 34/80; 34/90; 34/610; 68/5 R; 68/19

(58) Field of Classification Search ..... 34/60, 80, 34/90, 595, 601, 602, 603, 610; 68/5 R, 68/19

See application file for complete search history.

(56) References Cited

U.S. PATENT DOCUMENTS

| | | | | |
|---|---|---|---|---|
| 2,114,776 | A * | 4/1938 | Davis | 68/18 R |
| 5,343,632 | A * | 9/1994 | Dinh | 34/507 |
| 6,904,703 | B2 * | 6/2005 | Naganawa et al. | 34/596 |
| 7,882,716 | B2 * | 2/2011 | Noro et al. | 68/18 C |
| 2004/0010937 | A1 * | 1/2004 | Naganawa et al. | 34/595 |
| 2005/0072022 | A1 | 4/2005 | Nagae et al. | |
| 2009/0049872 | A1 * | 2/2009 | Noro et al. | 68/18 C |
| 2009/0241606 | A1 * | 10/2009 | Yoo et al. | 68/5 C |
| 2009/0274985 | A1 * | 11/2009 | McKnight et al. | 431/36 |
| 2010/0018228 | A1 * | 1/2010 | Flammang et al. | 62/115 |
| 2010/0043245 | A1 * | 2/2010 | Noviello | 34/60 |

(Continued)

FOREIGN PATENT DOCUMENTS

DE 4432489 A1 * 3/1996

(Continued)

OTHER PUBLICATIONS

International Search Report of PCT/EP2008/001094 dated Apr. 22, 2008.

*Primary Examiner* — Stephen M. Gravini
(74) *Attorney, Agent, or Firm* — Banner & Witcoff, Ltd

(57) ABSTRACT

A home laundry drier (1) having a drying tub (3) housing the laundry to be dried, and a closed-circuit, heat-pump-type, hot-air generator (4) for circulating a stream of hot air inside the drying tub (3); the hot air generator (4) also having a tank (15) containing a predetermined amount of water, heating means for converting the water in the tank (15) to steam, and an exhaust manifold (17) for feeding the steam produced in the tank (15) to the drying tub (3); the heating means being defined by at least one portion (16) of the pipe (10) feeding refrigerant from the compressor (7) to the condenser (9).

6 Claims, 1 Drawing Sheet

U.S. PATENT DOCUMENTS

| | | | | |
|---|---|---|---|---|
| 2011/0167664 | A1 * | 7/2011 | Favret et al. | 34/134 |
| 2011/0225857 | A1 * | 9/2011 | Kim et al. | 38/3 |

FOREIGN PATENT DOCUMENTS

| | | | | |
|---|---|---|---|---|
| EP | 1666655 | A | | 6/2006 |
| EP | 1961857 | A1 | * | 8/2008 |
| JP | 01056099 | A | * | 3/1989 |
| JP | 07178289 | A | * | 7/1995 |
| JP | 2003-265880 | | | 9/2003 |
| JP | 2003 265880 | A | | 9/2003 |
| JP | 2008067742 | A | * | 3/2008 |

* cited by examiner

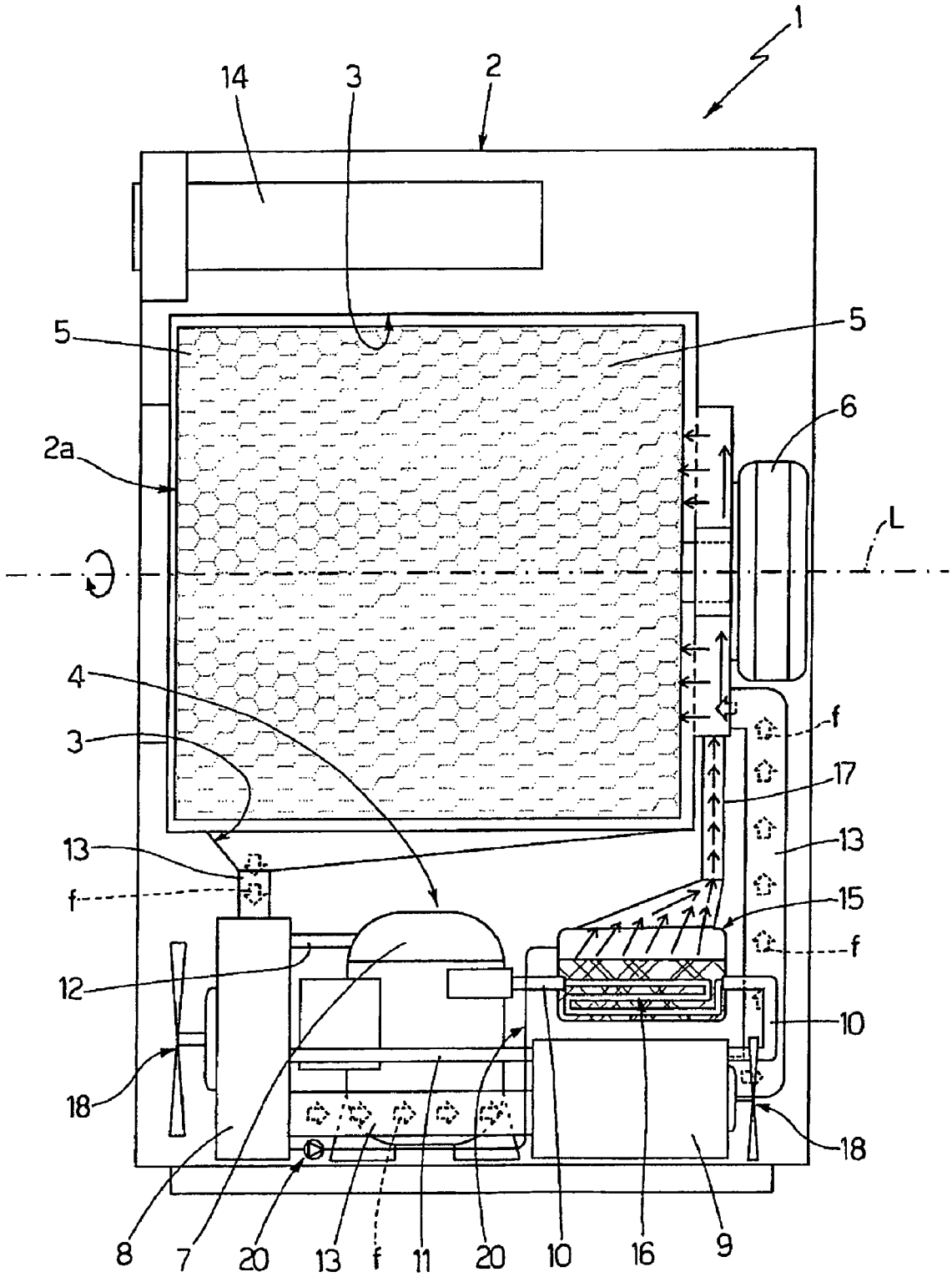
1
2
3
14
5
5
6
2a
L
4
3
f
17
13
13
f
15
f
12
10
18
18
8
7
20
13
f
11
20
10
16
9

HOME LAUNDRY DRIER

FIELD OF THE INVENTION

The present invention relates to a home laundry drier.

More specifically, the present invention relates to a rotary-drum home laundry drier, to which the following description refers purely by way of example.

BACKGROUND OF THE INVENTION

As is known, rotary-drum laundry driers substantially comprise a substantially parallelepiped-shaped outer box casing; a cylindrical laundry drying tub fixed horizontally inside the casing, directly facing a laundry loading and unloading opening formed in the front face of the casing; a door hinged to the front face of the casing to rotate to and from a work position closing the opening in the front face to seal the cylindrical tub; a cylindrical, perforated-wall, laundry drum housed in axially rotating manner inside the drying tub; and an electric motor for rotating the laundry drum about its longitudinal axis inside the drying tub.

Rotary-drum laundry driers of the above type also comprise a hot-air generator designed to produce and circulate inside the drying tub a stream of hot air with a low moisture level and which flows through the laundry drum to rapidly dry the laundry inside.

In some recently marketed driers, the hot-air generator operates in the same way as a heat pump, and circulates the same air continually inside the drying tub, by continually extracting the surplus moisture from the hot air issuing from the drying tub after flowing over the laundry inside the drum.

Though more energy efficient than driers with an open-circuit, hot-air generator, driers with a closed-circuit, heat-pump-type, hot-air generator have revealed several functional, commercially unpopular drawbacks. A heat-pump-type, hot-air generator, in fact, comprises a large number of component parts—some relatively bulky—that are difficult to accommodate inside the box casing, and which may even take up almost all the space available inside the household appliance, thus making it extremely difficult and expensive to equip the appliance with other performance-improving devices, as in other drier models.

For example, some recently marketed rotary-drum driers with an open-circuit, hot-air generator also feature a pressurized-steam generator which, at the end of the drying cycle, feeds a jet of steam into the drying tub to eliminate or at least greatly reduce creasing of the dried fabrics.

Unfortunately, known pressurized-steam generators are too big to accommodate inside the already crowded box casing of a drier with a heat-pump-type, hot-air generator.

SUMMARY OF ILLUSTRATIVE INVENTIVE ASPECTS

It is an object of the present invention to provide a home laundry drier comprising both a heat-pump-type, hot-air generator, and a steam generator for eliminating creasing of the dried fabrics.

According to the present invention, there is provided a home laundry drier as claimed in the independent claim(s) claim 1 and preferably, though not necessarily, in any one of the claims depending directly or indirectly on the independent claims.

BRIEF DESCRIPTION OF THE DRAWING

The present invention will be described with reference to the attached drawing, which shows a side view, with parts in section and parts removed for clarity, of a home laundry drier in accordance with the teachings of the present invention.

DETAILED DESCRIPTION OF EXAMPLE EMBODIMENTS

Number 1 in the attached drawing indicates as a whole a home laundry drier substantially comprising a preferably, though not necessarily, parallelepiped-shaped outer box casing 2; an airtight, preferably, though not necessarily, cylindrical laundry drying tub or chamber 3 for housing the laundry to be dried, and which is fixed substantially horizontally inside casing 2, directly facing a laundry loading and unloading opening 2*a* formed in the front face of casing 2; a door (not shown) hinged to the front face of casing 2 to rotate to and from a work position closing opening 2*a* in the front face to seal the laundry drying tub 3; and a closed-circuit, hot-air generator 4 which is housed inside casing 2 and is designed to circulate inside drying tub 3 a stream of hot air having a low moisture level, and which flows over and rapidly dries the laundry inside the tub.

Drier 1 preferably, though not necessarily, also comprises a preferably, though not necessarily, cylindrical laundry drum 5 for housing the laundry to be dried, and which has perforated walls, or at least walls permeable to air, and is housed in axially rotating manner and preferably, though not necessarily, horizontally inside drying tub 3; and an electric motor 6 or similar, for rotating laundry drum 5 about its longitudinal axis L inside drying tub 3. In the example shown, longitudinal axis L coincides with the longitudinal axis of drying tub 3.

Casing 2, drying tub 3, the door, laundry drum 5, and electric motor 6 are commonly known parts in the industry, and therefore not described in detail.

As for hot-air generator 4, on the other hand, this operates in the same way as a heat-pump—which transfers heat from one fluid to another using an intermediate gaseous refrigerant subjected to a closed thermodynamic cycle, the thermodynamic principles of which are widely known and therefore not described in detail—and provides for gradually drawing air from drying tub 3; extracting surplus moisture from the hot air drawn from drying tub 3; heating the dehumidified air to a predetermined temperature, normally higher than the air temperature inside drying tub 3; and feeding the heated, dehumidified air back into drying tub 3, where it flows again over, to rapidly dry, the laundry inside the tub.

In other words, hot-air generator 4 provides for continually dehumidifying and heating the air inside drying tub 3 to rapidly dry the laundry inside the tub.

With reference to the accompanying drawing, hot-air generator 4 substantially comprises:

a refrigerant compressing device 7—commonly referred to as a compressor—which subjects the refrigerant to compression (e.g. adiabatic compression) so that refrigerant pressure and temperature are much higher at the outlet than at the inlet of compressing device 7;

a first heat exchanger 8—commonly referred to as an evaporator—through which the refrigerant to compressor 7 and the airflow f from drying tub 3 flow simultaneously, and which is designed so that the refrigerant absorbs heat from airflow f from drying tub 3, while at the same time condensing the surplus moisture in airflow f;

a second heat exchanger 9—commonly referred to as a condenser—through which the refrigerant from compressor 7 and the airflow f back to drying tub 3 flow simultaneously, and which is designed so that the refrigerant releases heat to airflow f flowing into drying tub 3; and a refrigerant expansion member (not shown)—for example an expansion valve or a capillary pipe—where refrigerant flowing from condenser 9 to evaporator 8 is expanded rapidly, so that refrigerant pressure and temperature are much lower at the outlet than at the inlet of the expansion valve, thus completing the closed thermodynamic cycle in opposition to compressor 7, which provides for rapidly compressing the refrigerant.

Hot-air generator 4 also comprises a first connecting pipe 10 for feeding the refrigerant from compressor 7 to condenser 9; a second connecting pipe 11 for feeding the refrigerant from. condenser 9 to evaporator 8 via the refrigerant expansion member (not shown); and a third connecting pipe 12 for feeding the refrigerant from evaporator 8 to compressor 7.

With reference to the attached drawing, hot-air generator 4 also comprises a number of air-circulating conduits 13 connecting drying tub 3 to evaporator 8, evaporator 8 to condenser 9, and condenser 9 back to drying tub 3, so that the airflow f coming out from drying tub 3, before flowing back into the tub, is forced to flow in rapid succession through evaporator 8, where surplus moisture is extracted by condensation, and then through condenser 9, where airflow f is brought to a temperature higher than or equal to the outflow temperature from drying tub 3; all under the control of the electric central control unit 14 of the household appliance.

Unlike known heat-pump-type, hot-air generators, hot-air generator 4 also comprises a water tank 15 containing a predetermined amount of preferably, though not necessarily, demineralized water, a heater 16 for boiling and converting the water inside tank 15 to steam, and a steam exhaust manifold 17 for feeding the steam produced in tank 15 to drying tub 3; and heater 16 is defined by at least one portion 16 of pipe 10, which portion is designed to extend through tank 15 to allow the high-temperature refrigerant (normally over 100° C.) from compressor 7 to release heat to the water inside tank 15.

Electronic central control unit 14 of the household appliance obviously controls the active components of hot-air generator 4—such as the fans 18 for regulating heat exchange at evaporator 8 and condenser 9 and/or cooling of compressor 7—so as to regulate the temperature of the refrigerant from compressor 7 and so only produce steam inside tank 15 when required by the drying cycle, and possibly regulate the amount of steam as a function of the drying cycle.

Operation of drier 1 will be clear from the above description, with no further explanation required.

The advantages of using a portion of delivery pipe 10 of compressor 7 as a heater to produce steam are obvious: heat-pump-type, hot-air generator 4 can also be operated as a steam generator by simply providing an additional tank 15 and steam exhaust manifold 17, which are extremely cheap to produce and can be accommodated easily, even inside the already crowded box casing 2.

Clearly, changes may be made to laundry drier 1 as described herein without, however, departing from the scope of the present invention.

For example, in one variation, drier 1 also comprises a process water recovery circuit 20, which, on command, extracts the liquid distilled water which accumulates, when the drier is running, on the bottom of evaporator 8 as a consequence of condensation of the surplus moisture in the airflow f from drying tub 3, and feeds the distilled water to tank 15 for use in producing steam.

The invention claimed is:

1. A home laundry drier comprising a drying tub for housing the laundry to be dried, and a hot-air generator for circulating a stream of hot air inside the drying tub; the hot-air generator comprising refrigerant compressing means for compressing a refrigerant so that the pressure and temperature of the refrigerant at the outlet of the compressing means are higher than the pressure and temperature of the refrigerant at the inlet of said compressing means; a first heat exchanger, through which the refrigerant from said compressing means and an airflow into said drying tub flow, and which is designed so that the refrigerant releases heat to the airflow into the drying tub; and a connecting pipe for feeding the refrigerant from said compressing means to said first heat exchanger; said laundry drier being characterized in that the hot-air generator also comprises a tank containing a predetermined amount of water, heating means for converting the water in said tank to steam, and an exhaust manifold for feeding the steam produced in the tank to said drying tub; said heating means being defined by at least one portion of said connecting pipe.

2. A laundry drier as claimed in claim 1, characterized in that said hot-air generator also comprises a second heat exchanger, through which the refrigerant to said compressing means and the airflow from the drying tub flow, and a number of air-circulating conduits connecting the drying tub to the second heat exchanger, the second heat exchanger to the first heat exchanger, and the first heat exchanger back to said drying tub, so that the airflow coming out from the drying tub, before flowing back into the drying tub, is forced to flow in rapid succession through said second and said first heat exchanger; said second heat exchanger being designed so that the refrigerant absorbs heat from the airflow from said drying tub, thus condensing the surplus moisture in said airflow.

3. A laundry drier as claimed in claim 2, characterized in that said hot-air generator also comprises a process water recovery circuit which, on command, extracts water accumulated, when the household appliance is running, in said second heat exchanger, and feeds the water to said tank for use in producing steam.

4. A laundry drier as claimed in claim 1, characterized by also comprising a laundry drum for housing the laundry to be dried, and which has walls permeable to air, and is housed in axially rotating manner inside said drying tub; and a drive unit for rotating said laundry drum about its longitudinal axis inside the drying tub.

5. A laundry drier as claimed in claim 2, characterized by also comprising a laundry drum for housing the laundry to be dried, and which has walls permeable to air, and is housed in axially rotating manner inside said drying tub; and a drive unit for rotating said laundry drum about its longitudinal axis inside the drying tub.

6. A laundry drier as claimed in claim 3, characterized by also comprising a laundry drum for housing the laundry to be dried, and which has walls permeable to air, and is housed in axially rotating manner inside said drying tub; and a drive unit for rotating said laundry drum about its longitudinal axis inside the drying tub.

* * * * *